US007350306B2

(12) United States Patent
Reed et al.

(10) Patent No.: US 7,350,306 B2
(45) Date of Patent: Apr. 1, 2008

(54) EASY STAIRS

(76) Inventors: Michael G. Reed, 30984 Joy La., Hermiston, OR (US) 97828; Traci L. Reed, 30984 Joy La., Hermiston, OR (US) 97828

( * ) Notice: Subject to any disclaimer, the term of this patent is extended or adjusted under 35 U.S.C. 154(b) by 0 days.

(21) Appl. No.: 11/486,571

(22) Filed: Jul. 14, 2006

(65) Prior Publication Data

US 2007/0113416 A1 May 24, 2007

Related U.S. Application Data

(60) Provisional application No. 60/700,445, filed on Jul. 15, 2005.

(51) Int. Cl.
*B43L 7/00* (2006.01)
*E04F 21/26* (2006.01)

(52) U.S. Cl. ..... 33/474; 33/420

(58) Field of Classification Search ..... 33/418, 33/419, 420, 421, 474
See application file for complete search history.

(56) References Cited

U.S. PATENT DOCUMENTS 373,929 A * 11/1887 Gillette ..... 33/474
539,534 A * 5/1895 McKinney ..... 33/474
973,584 A * 10/1910 Thomas ..... 33/341
1,289,047 A * 12/1918 Hall ..... 403/85
1,438,432 A * 12/1922 Evans ..... 33/420
1,480,925 A * 1/1924 Wright ..... 33/420
1,770,304 A * 7/1930 Ferris ..... 33/421
2,031,661 A * 2/1936 Mendenhall ..... 33/420
2,511,654 A * 6/1950 Spoor ..... 33/443
3,153,859 A * 10/1964 Jones ..... 33/419
4,507,869 A * 4/1985 Stude ..... 33/42
4,539,759 A * 9/1985 Dowzall et al. ..... 33/615
4,712,307 A * 12/1987 Kish ..... 33/421
4,916,822 A * 4/1990 Johnson ..... 33/458
5,083,380 A * 1/1992 Robertson ..... 33/562
5,388,340 A * 2/1995 Marty ..... 33/421
5,430,947 A * 7/1995 Courtney ..... 33/484
6,070,334 A * 6/2000 Pretsch, Jr. ..... 33/474

* cited by examiner

*Primary Examiner*—R. Alexander Smith
(74) *Attorney, Agent, or Firm*—Raymond M. Galasso; Galasso & Associates LP

(57) ABSTRACT

Easy Stairs is an L-shaped device having a diagonal sliding rod attached to the two sides. Connectors with locking devices allow the diagonal rod to firmly affix to the sides at various locations. To use Easy Stairs, a user adjusts the diagonal rod along the edge of a stringer. When it is in the correct position for the proper size stair, the lock lever is activated. A line can then be drawn on the inside edge of the device on both sides, forming the shape of the stair. The same stair size is then repeated as many times as is necessary to make a staircase of appropriate size.

11 Claims, 2 Drawing Sheets

EASY STAIRS

CROSS REFERENCE TO RELATED APPLICATIONS

This U.S. Non-Provisional Patent Application claims priority to U.S. Provisional Patent Application No. 60/700,445 entitled "Easy Stairs" filed on Jul. 15, 2005.

FIELD OF THE DISCLOSURE

The disclosures made herein relate generally to the household improvement industry. The invention discussed herein is in the general classification of stair construction devices.

BACKGROUND

Building uniform stairs is one of the more difficult and tedious tasks for a carpenter. A layman often finds the task exceedingly difficult and often discovers after many hours of labor that the stairs he built are inconsistently sized and spaced.

Traditionally, a carpenter's square is used to measure and mark the stringers for stair building. However, a carpenter's square does not adjust, leaving the user to remember the dimensions of the previous stair and consistently mark the stairs along the stringer.

Hence, there is a need in the art for a convenient, inexpensive and effective device for measuring stairs that permits uniform repetition of stair dimensions.

SUMMARY OF THE DISCLOSURE

Easy Stairs is an L-shaped device having a diagonal sliding rod attached to the two sides. Connectors with locking devices allow the diagonal rod to firmly affix to the sides at various locations in the preferred embodiment.

The principal object of this invention is to provide a device that can be used to measure stairs.

Another object of this invention is to provide a device that can be easily used by carpenters or layman to efficiently measure stairs.

Another object of this invention is to provide an affordable device for measuring stairs.

Another object of this invention is to provide a device that will permit a user to make a set of stairs uniform in size.

Yet another object of the invention is to provide a device that will allow a user to lock the device in place to insure accuracy in measurements.

DETAILED DESCRIPTION OF THE DRAWINGS

The preferred embodiment of Easy Stairs is comprised of at least some of the following: an L-shaped device having a diagonal, telescoping and pivoting sliding rod attached to the two sides via connectors. The connectors move on ball bearings and have locking devices to allow the sliding rod to firmly affix to the sides at various locations marked along the two sides.

Figure 1:
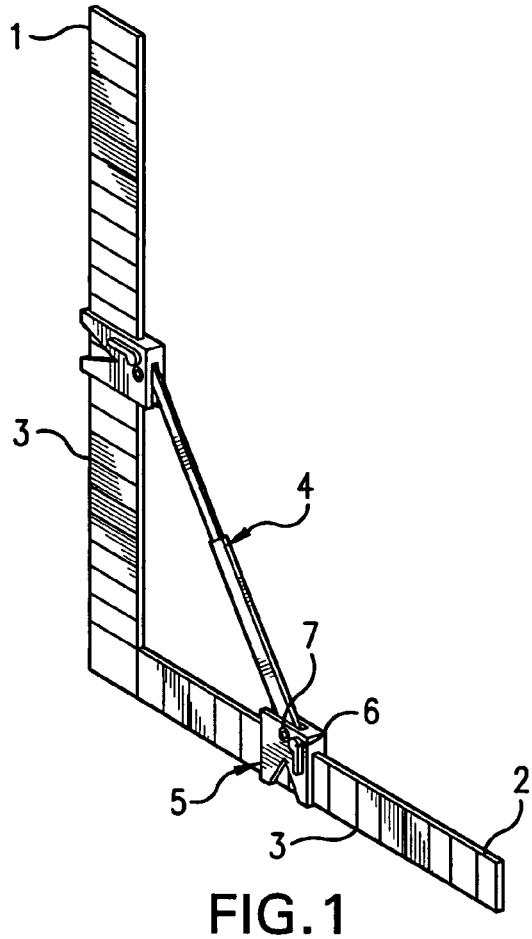
FIG. 1 depicts a perspective view of the preferred embodiment of the present invention.

FIG. 1 shows the preferred embodiment of the present invention. A first side 1 is located perpendicular to a second side 2. Along the length of the first side 1 and the second side 2, increments 3 for measuring are shown. The first side 1 and second side 2 form an L-shape. The first side 1 and second side 2 are made of steel, although other types of metals or materials may also be utilized. The first side 1 is approximately 24 inches in length while the second side 2 is approximately 16 inches in length. The first side 1 has a width of two inches and the second side 2 has a width of approximately one and one-half inches. The thickness of both the first side 1 and the second side 2 is approximately one sixteenth of an inch. A diagonal sliding rod 4 is connected to the first side 1 and the second side 2 via connectors 5. The diagonal sliding rod 4 is made of steel though other materials may also be utilized. The diagonal sliding rod 4 is telescoping to permit it to be extended and shortened as appropriate. The connectors 5 utilize ball bearings to slide along the length of the first side 1 and the second side 2 to accommodate various size stairs. Locking devices 6 permit the connectors 5 to be firmly affixed in a designated location along the first side 1 and the second side 2. Pivots 7 on the connectors 5 allow the diagonal sliding rod 4 to change orientation when it is being extended or shortened. A diagonal sliding rod 4 is connected to the first side 1 and the second side 2 via connectors 5. The diagonal sliding rod 4 is made of steel though other materials may also be utilized. The diagonal sliding rod 4 is telescoping to permit it to be extended and shortened as appropriate. The connectors 5 utilize ball bearings to slide along the length of the first side 1 and the second side 2 to accommodate various size stairs. Locking devices 6 permit the connectors 5 to be firmly affixed in a designated location along the first side 1 and the second side 2. Pivots 7 on the connectors 5 allow the diagonal sliding rod 4 to change orientation when it is being extended or shortened.

A diagonal sliding rod 4 is connected to the first side 1 and the second side 2 via connectors 5. The diagonal sliding rod 4 is made of steel though other materials may also be utilized. The diagonal sliding rod 4 is telescoping to permit it to be extended and shortened as appropriate. The connectors 5 utilize ball bearings 8 to slide along the length of the first side 1 and the second side 2 to accommodate various size stairs. Locking devices 6 permit the connectors 5 to be firmly affixed in a designated location along the first side 1 and the second side 2. Pivots 7 on the connectors 5 allow the diagonal sliding rod 4 to change orientation when it is being extended or shortened.

Figure 2:
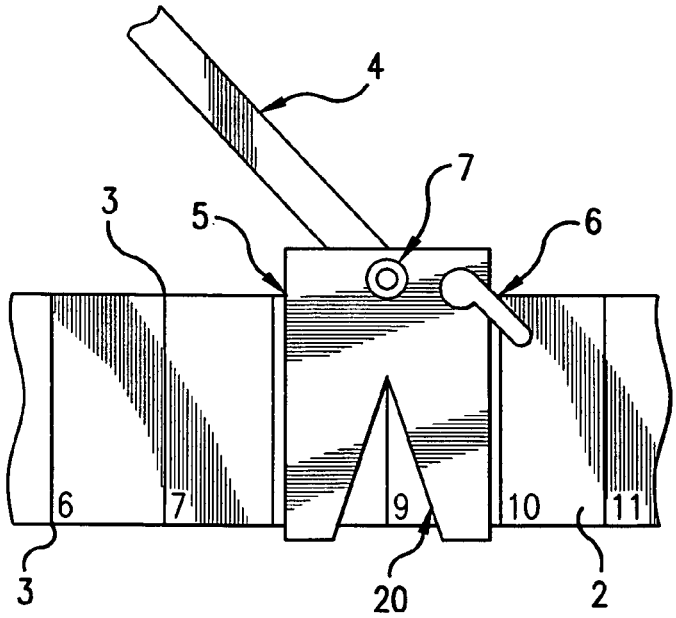
FIG. 2 depicts a close-up view of the connectors of the preferred embodiment of the present invention.
Figure 3:
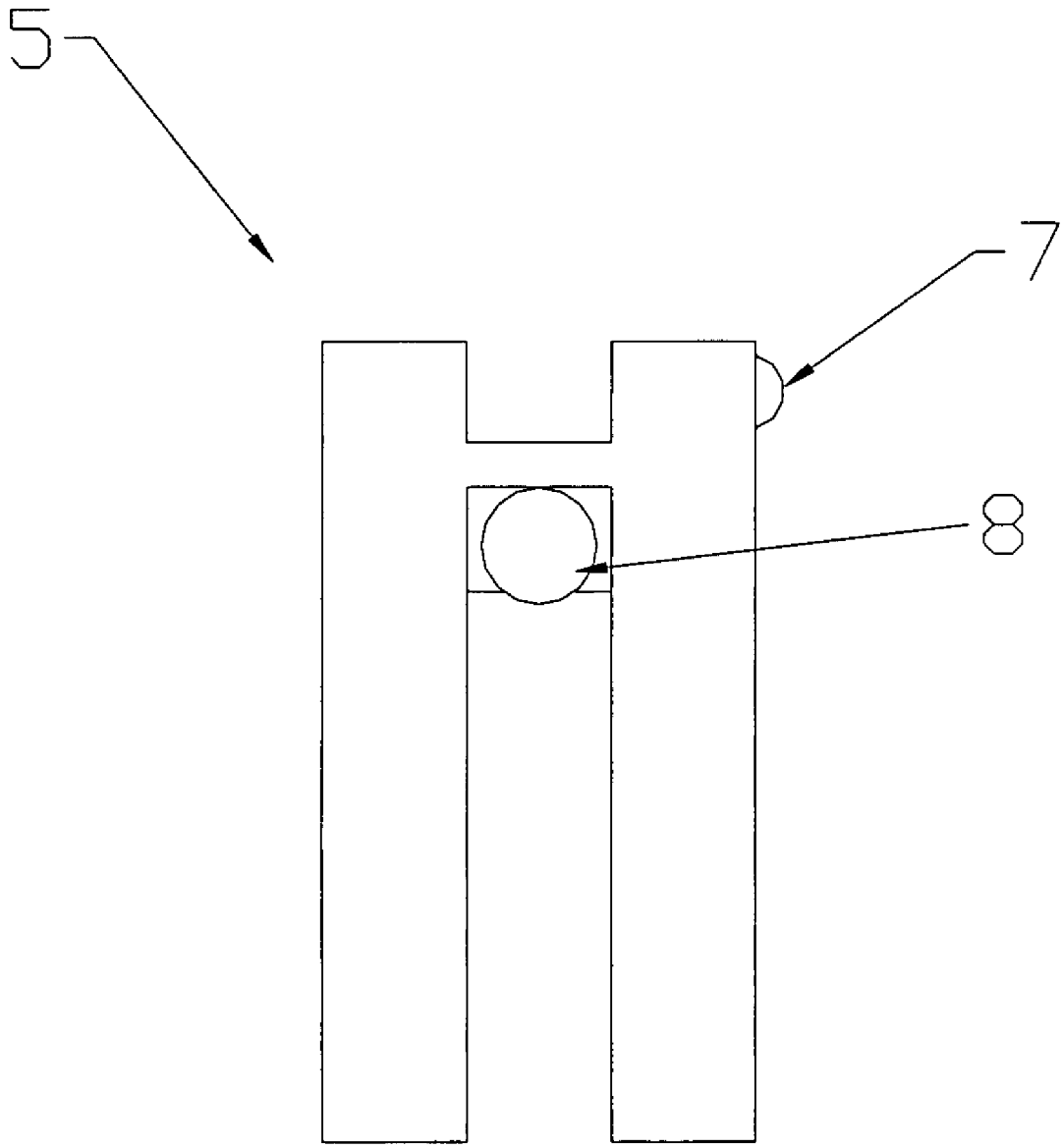
FIG. 3 depicts a cross-sectional view of the connectors of the preferred embodiment of the present invention.

FIG. 2 depicts a close-up view of the connectors of the preferred embodiment of the invention. The diagonal sliding rod 4 attached to the pivot 7 of the connectors can be seen in greater detail. Also shown are the locking devices 6 that press against the first side and second side 2. The increments 3 can be seen through the V-shaped viewer 20 cut out of the connector 5.

To use Easy Stairs, a user adjusts the diagonal rod along the edge of a stringer, permitting it to telescope and pivot as necessary. When it is in the correct position for the proper size stair, the lock lever is activated. A line can then be drawn on the inside edge of the device on both sides, forming the shape of the stair. The same stair size is then repeated as many times as is necessary to make a staircase of appropriate size.

The materials utilized for Easy Stairs may vary widely but will likely include metal and plastic. The metals would ideally be selected from available steel or alloys of steel and aluminum. The production process related to the use of these metals insures that the metal is non-corrosive, durable and strong. The selected metal should have high impact strength and be capable of accepting and retaining coloring materials for an extended length of time.

The plastic used in the production will ideally be selected for durability and longevity. Thermoplastics are commonly used in the manufacturing of components similar to those used in this invention. Polyethylene, polypropylene, and other similar thermoplastic materials would be among those with the necessary traits. Members of this family are recognized universally as being versatile and of high quality.

The plastic components of Easy Stairs can also be formed with the use of plastic molding techniques, such as injection molding or blow molding. Injection molding requires melted plastic to be forcefully injected into relatively cool molds. As the plastic begins to harden, it takes on the shape of the mold cavity. This technique is ideal for the mass production of products. Alternatively, blow molding, a form of extrusion, could be utilized. Blow molding involves a molten tube being pushed into a mold. Compressed air then forces the molten tube against the cold walls of the mold.

It should be obvious that the components of the present invention can be of various shapes and sizes. It should also be obvious that the components of the invention can be made of different types of plastics or other suitable materials and can be of any color. While the device described herein is primarily used in conjunction with stair building, it could also be used for a variety of other home improvement tasks or carpentry that require measurements and/or repetition of identically sized units.

It will be recognized by those skilled in the art that changes or modifications may be made to the above-described embodiments without departing from the broad inventive concepts of the invention. It should therefore be understood that this invention is not limited to the particular embodiments described herein, but is intended to include all changes and modifications that are within the scope and spirit of the invention as set forth in the claims.

What is claimed is:

1. A carpentry device comprising:

(a) a first side;

(b) a second side perpendicular to the first side;

(c) a first connector comprising a pivot, a V-shaped viewer and one or more ball bearings capable of sliding along the first side;

(d) a second connector comprising a pivot, a V-shaped viewer and one or more ball bearings capable of sliding along the second side; and (e) a diagonal rod connected to the first connector at the pivot on the first side and the second connector at the pivot on the second side.

2. The device of claim 1 wherein the first side and the second side are made of steel.

3. The device of claim 1 wherein the first side and the second side are made of aluminum.

4. The device of claim 1 wherein the diagonal rod is made of steel.

5. The device of claim 1 wherein the diagonal rod is made of aluminum.

6. The device of claim 1 wherein the diagonal rod is telescoping.

7. The device of claim 1 wherein the first connector and the second connector are made of metal.

8. The device of claim 1 wherein the first connector and the second connector are made of plastic.

9. The device of claim 1 wherein a first locking device is located on the first connector and the second locking device is located on the second connector.

10. The device of claim 1 further comprising:

a first set of increments along the first side and a second set of increments along the second side.

11. A carpentry device comprising:

(a) a first side made of steel;

(b) a second side made of steel perpendicular to the first side;

(c) a diagonal rod made of steel that telescopes and is attached to the first side via a first connector made of metal and the second side via a second connector made of steel;

(d) a first set of ball bearings attached to the first connector and a second set of ball bearings attached to the second connector;

(e) a first locking device located on the first connector and a second locking device located on the second connector;

(f) a first pivot located on the first connector and a second pivot located on the second connector;

(g) a first set of increments located on the first side and a second set of increments located on the second side;

(h) a first V-shaped cut out on the first connector and a second V-shaped viewer cut out of the second connector.

* * * * *